United States Patent [19]

Kotecki et al.

[11] Patent Number: 5,025,987

[45] Date of Patent: Jun. 25, 1991

[54] RAIL SECUREMENT APPARATUS

[75] Inventors: Michael R. Kotecki, Brookfield; Duane J. Bunchkowski, Muskego, both of Wis.

[73] Assignee: Harnischfeger Engineers, Inc., Brookfield, Wis.

[21] Appl. No.: 390,555

[22] Filed: Aug. 7, 1989

[51] Int. Cl.[5] ..... E01B 9/48; E01B 13/02

[52] U.S. Cl. ..... 238/351; 238/342; 238/377

[58] Field of Search ..... 238/349, 310, 323, 377, 238/378, 342, 343, 350, 351; 248/72

[56] References Cited

U.S. PATENT DOCUMENTS 497,679 5/1893 Newbury ..... 248/72

3,934,800 1/1976 Molyneux ..... 238/310 X

FOREIGN PATENT DOCUMENTS 1122255 8/1968 United Kingdom ..... 238/310

*Primary Examiner*—Joseph F. Peters, Jr.

*Assistant Examiner*—Virna Lissi Mojica

*Attorney, Agent, or Firm*—Richard C. Ruppin

[57] ABSTRACT

A rail securement clip is disclosed as having a base having an opening therethrough for receiving an anchor projecting from a foundation, a nose extending laterally of the base from the upper portion of the base and overlying the foot of the rail, and a pair of spaced apart fingers affixed to the nose and to an upper portion of the base. The through opening in the base has an orifice positioned in the space between the fingers. The base and fingers form a recess into which the anchor projects. Securement means may be fastened to the anchor and positioned within the recess to hold the apparatus against the rail and thereby secure the rail to the foundation. The nose may include a rubber pad means engaging the foot of the rail to provide an energy absorbing securement of the rail. The through opening in the base may have an open side facing in the direction of the lateral extension of the nose from the base so that the anchor projecting through the opening may be positioned adjacent to or in engagement with the foot of the rail.

11 Claims, 1 Drawing Sheet

RAIL SECUREMENT APPARATUS

FIELD OF THE INVENTION

This invention relates to an apparatus for securing a rail to a foundation and, in particular, to a rail securement clip utilizing rubber pad means engageable with the rail to absorb rail movement energy and secure the rail in place.

BACKGROUND OF THE INVENTION

Various types of movable industrial equipment travel along rails mounted on a supporting foundation. Typical of this type of equipment are cranes which may be supported on rails mounted on overhead beams or on rails mounted on a foundation floor or sole plate. The rails are usually secured to the foundation by a series of anchors and clips at regular intervals along the length of the rail. A common type of anchor includes a threaded stud fastened to the foundation perpendicular to its surface and near the foot of the rail. A steel clip fits on the anchor against the foundation and overlaps the foot of the rail. A washer is placed over the stud and against the clip and a nut is threaded on the stud against the washer and clip to sandwich the rail foot between the clip and the foundation. Alternatively, a hole may be threaded in the foundation and a bolt may be inserted through the clip and threaded into the hole to fasten the clip against the rail and secure the rail to the foundation.

A well known clip design comprises a rectangular block of steel having a length in a direction laterally of the length of the rail that is somewhat longer than a width parallel to the length of the rail. The clip has a slot-shaped through opening that is centered in the long direction of the clip, i.e. in a direction laterally of the rail length. A portion of the bottom of the clip is tapered to accommodate the upward slant of the rail foot. Most rail systems for industrial equipment being currently installed utilize 60 pound per yard rail stock. The clips typically used in these systems have slotted openings that allow the anchor stud to be placed almost directly against the edge of the foot of the rail.

In recent design improvements, rail clips of a "rubber nosed" type have been developed and used in combination with rubber pads placed under the entire rail. Use of rubber nosed clips together with rubber pads provides a combination fastening/foundation system that is flexible vertically and absorbs vibration that places high stress on anchors.

Currently used rubber nosed rail clips require a minimum spacing between the anchor stud or bolt and the foot of the rail ranging approximately from ½" to 1". Also, rubber nosed rail clips often have a greater height than the relatively standard type older steel clips due to the addition of the rubber material in the nose of the clip. The additional height and the increased spacing between the anchor and the foot of the rail required by rubber nosed rail clips presents particularly difficult problems when rail installations are being renovated and it is desired to convert the rail securement devices from the older steel clips to a rubber nosed type clip. These problems include the removal and replacement of the anchors at a greater distance from the foot of the rail, and the installation of longer anchors to fasten greater height clips and also to accommodate increased rail height due to the addition of a rubber pad beneath the rail. In addition, increasing the anchor and clip heights may obstruct the moving of the equipment wheels on the rails so that rubber nosed clips cannot actually be used.

The applicants' invention is an improvement over presently known rail securement clips having the drawbacks described above.

SUMMARY OF THE INVENTION

It is a general object of this invention to provide an apparatus for securing a rail to a foundation which has a minimum height so as to avoid obstructing equipment traveling on the rail. Another object of the invention is to provide an apparatus for securing a rail to a foundation by means of an anchor extending from the foundation which permits the anchor to be positioned adjacent to or in contact with the foot of the rail. A further object of the invention is to provide a rail securement apparatus having rubber rail engagement means and which has a height which will not obstruct equipment traveling on the rail. The invention is carried out by providing an apparatus including a base having an opening therethrough for receiving an anchor projecting from a foundation, a nose extending laterally of the base from the upper portion of the base and overlying the foot of the rail, and a pair of spaced apart fingers affixed to the nose and to an upper portion of the base. The through opening in the base has an orifice positioned in the space between the fingers.

The base and fingers form a recess into which the anchor projects and securement means may be fastened to the anchor and positioned within the recess to hold the apparatus against the rail and thereby secure the rail to the foundation. The nose may include a rubber pad means engaging the foot of the rail to provide an energy absorbing securement of the rail.

The through opening in the base may have an open side facing in the direction of the lateral extension of the nose from the base so that the anchor projecting through the opening may be positioned adjacent to or in engagement with the foot of the rail. In order to accommodate the anchor projecting through the base adjacent to or in contact with the foot of the rail and the securement means attached to the anchor, the nose has a side facing the securement means which is spaced laterally from the base. The rubber pad means may comprise two spaced apart portions with the nose side facing the securement means between the rubber pad portions. The rubber pad means will thereby not interfere with the attachment of the securement means to the anchor or the positioning of the anchor against the rail foot.

BRIEF DESCRIPTION OF THE DRAWINGS

Further objects and advantages will appear when taken in conjunction with the accompanying drawings, in which.

DETAILED DESCRIPTION OF THE INVENTION

Figure 1:
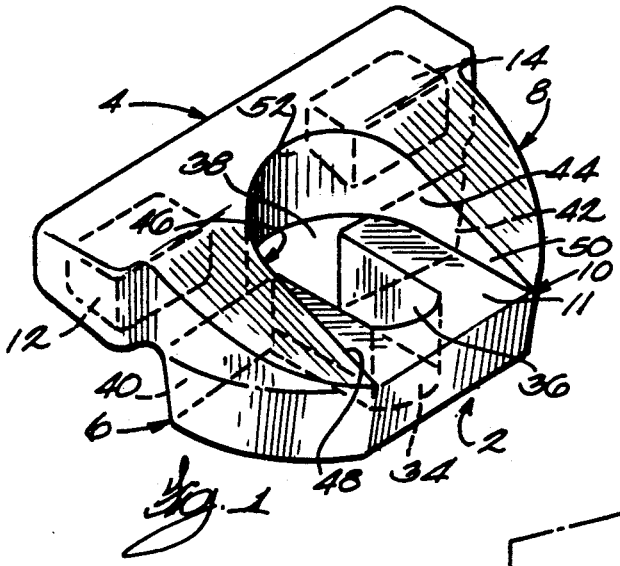
FIG. 1 is a perspective view of the rail securement apparatus according to the invention.

Referring generally to FIGS. 1–4, the rail securement apparatus includes a base 2 having an upper portion 10, a nose 4 having rubber pads 12 and 14, and spaced apart fingers 6 and 8 affixed to the nose 4 and to the upper portion 10 of the base.

Figure 2:
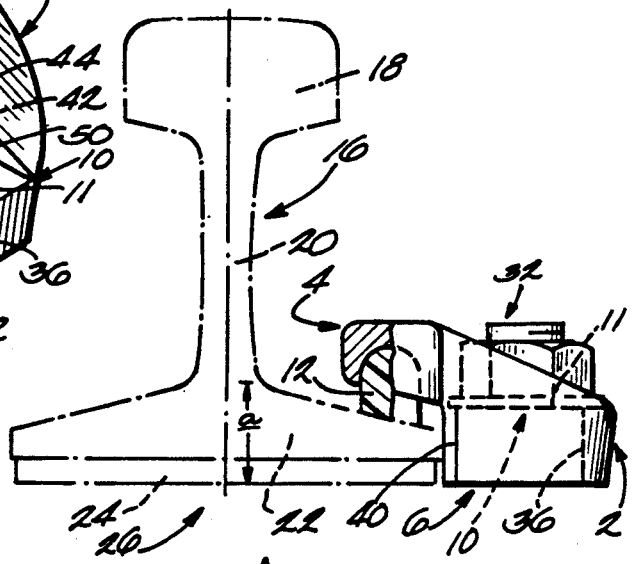
FIG. 2 is a side elevation view of the apparatus shown in FIG. 1 illustrating the apparatus securing a rail in position on a foundation.

A rail 16 has a head 18, a flange 20 and a foot 22 for supporting equipment traveling on the rail. The rail rests on a rubber rail pad 24 and has a length in the direction of the center line 28 shown in FIG. 4. The foot 22 has a height above the foundation 26 identified by the letter a as shown in FIG. 2. An anchor stud 30 projects from the foundation 26 and a securement means 32 is attached to the anchor stud 30 against the surface 11 of the upper portion 10 of the base which is not greater than the height a of the foot 22, as shown in FIG. 2 2. The nose 4 of the rail securement apparatus over the foot 22 of the rail is such that when the securement means 32 is attached to the anchor 30 and against the base 2, the rail is secured to the foundation. It may be noted however, that the rail may in some cases be preferably secured to the foundation with the nose 4 overlying but not engaging the rail foot 22 so that the latter is merely restricted in its movement.

The base 2 includes a through opening 34 having an orifice 36 in the upper portion 10 of the base. The opening 34 has an open side 38 in the lateral direction of the base transverse to the length of the rail 16 and toward the rail foot 22. The base 2 further includes lateral sides 40 and 42 between which the open side 38 is positioned and which may be located in engagement with the rail foot 22 if desired for purposes of securing the rail 16 to the foundation 26.

Figure 4:
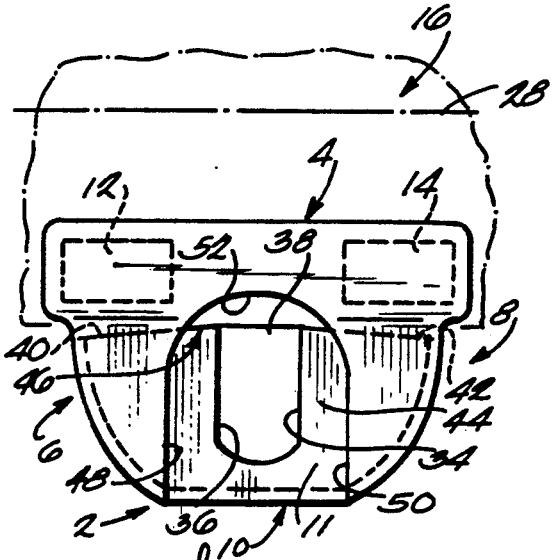
FIG. 4 is a plan view of the apparatus shown in FIG. 1.

The securement apparatus includes a recess 44 between and straddled by the fingers 6 and 8 in t which the orifice 36 of the opening 34 opens and which is formed by the upper portion 10 of the base 2, the fingers 6 and 8, and the nose 4. The recess has a wall 46 which comprises walls 48 and 50 respectively of fingers 6 and 8 and wall portion 52 of nose 4. As can be seen in FIGS. 1 and 4, the wall portion 52 of nose 4 comprising a part of the recess 44, is positioned in a lateral direction from the base 2 and the open side 38 toward the rail foot 22. Thus the nose 4 and the position of the recess 44 will not interfere with the position of the anchor 30 projecting through the base 2 and engaging the rail foot 22 and will permit and not interfere with the attachment of the securement means 32 to the anchor 30. The opening 34 may be slot shaped with a length in the lateral direction of the base 2 so that the rail securement apparatus may be adjustable in its engagement position with the rail foot 22 and on the anchor 30. The rubber pads 12 and 14 are spaced apart on the nose 4 so that they also do not interfere with the projection of the anchor 30 through the base 2 or the attachment of the securement means 32 to the anchor 30. The wall portion 52 of the nose 4, because of the spacing apart of the rubber pads 12 and 14, may be disposed in the space between the rubber pads 12 and 14 to provide the recess area required for attachment of the securement means 32 to the anchor 30 when the anchor 30 is adjacent to or extending out of the open side 38 and the securement means 32 is adjacent the wall portion 52 of the nose 4.

Because the nose 4 extends only from the upper portion 10 of the base 2, the base 2 itself may have a minimal height which in turn minimizes the height of the overall rail securement apparatus. However, the integrity of the rail clip is attained by also affixing the fingers 6 and 8 to the upper portion 10 of the base 2. The strength of the rail clip is enhanced if the fingers 6 and 8 are affixed to the upper portion of the base 2 along the full lateral width of the base 2, as shown in FIGS. 1–4.

Figure 3:
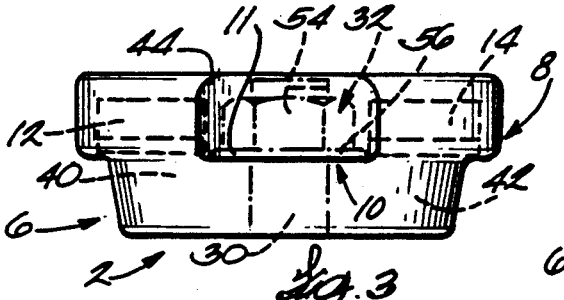
FIG. 3 is an end elevation view of the apparatus shown in FIG. 1 attached to an anchor projecting from a foundation.

The height of the nose 4 and the fingers 6 and 8, and thereby the height of the recess 44,.is such that the recess height will not exceed the typical height of the anchor 30 above the base 2 projecting from the foundation 26. Thus, where the rail securement apparatus is used as a replacement securement means in a renovation of a rail system, the rail securement apparatus will not exceed the height of the original anchors 30 from the foundation 26 and thereby interfere with the rail wheels of the equipment supported by the rail 16. A common type of anchor stud is the threaded anchor 30 illustrated in FIGS. 2 and 3, however, a threaded receptacle in the foundation into which a threaded bolt is inserted can also be utilized. A typical securement means 32 includes a threaded nut 54 and washer 56. As shown in FIGS. 2 and 3, the washer 56 is positioned over the anchor stud 30 against the surface 11 of the upper portion 10 of the base 2 and the nut 54 is threaded on the stud 30 against the washer to attach the securement apparatus to the anchor 30 and position the securement apparatus relative to the rail foot 22 and secure the rail 16 to the foundation. With the rail clip attached to the anchor 30, the rubber pads 12 and 14 overlie and engage the rail foot 22 in a resilient manner which results in the absorption of dynamic energy of the rail 16 and minimizes transfer of this energy to the anchor 30. Although it is common to position the rail clips and size the rubber nose pads 12 and 14 such that the nose pads permanently engage the rail foot 22, the rubber nose pads 12 and 14 may also be sized such that they overlie but do not always engage the foot 22, but are engaged by the foot 22 only as the result of movement of the rail 16 and foot 22.

Figure 5:
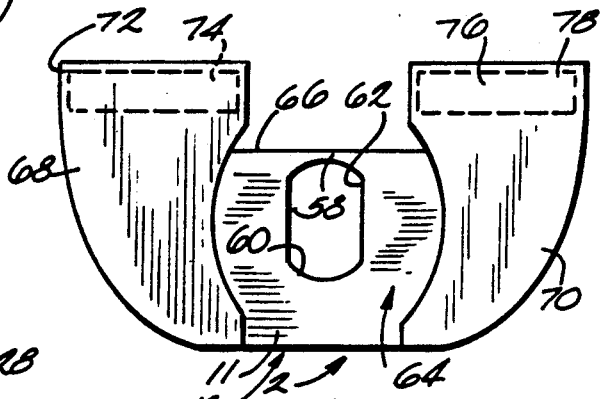
FIG. 5 is a plan view of an alternate embodiment of the invention.
Figure 6:
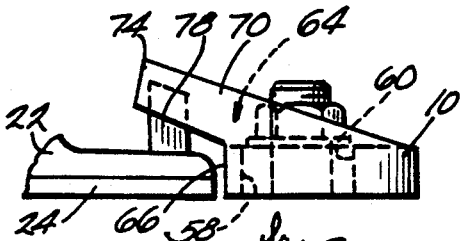
FIG. 6 is a side elevation view of the apparatus shown in FIG. 5.

In the embodiment of the invention illustrated in FIGS. 5 and 6, components which are identical to those illustrated in the embodiment of FIGS. 1–4 are designated by the same identifying numerals. The base 2 has an upper portion 10 having a through opening 60 including an orifice 62 opening in to a recess 64. The opening 60 includes a side 58 spaced from a lateral side 66 of the base 2 facing the rail foot 22. A pair of fingers 68 and 70, spaced apart in the lengthwise direction of the rail 16, are affixed to and extend from the upper portion 10 of the base 2. The finger 68 has a nose member 72 on which is mounted a rubber nose pad 74 and the finger 70 has a nose member 76 on which is mounted a rubber nose pad 78. The extension of the fingers 68 and 70 and their nose members in a lateral direction toward the rail foot 22 beyond the base side 66 and the space between the fingers and their nose members to form the recess 64 permits the positioning of the anchor stud 30 and securement means 32 in the through opening 60 adjacent the rail foot 22, as shown in FIG. 6.

It will be understood that the foregoing description of the present invention is for purposes of illustration only and that the invention is susceptible to a number of modifications or changes, none of which entail any departure from the spirit and scope of the present invention as defined in the hereto appended claims. For example, the embodiment of FIGS. 5 and 6 could be modified to include laterally open side adjacent rail foot 22 of the through opening 60 to permit engagement of the anchor 30 with the rail foot 22, if desired. Also, the embodiment of FIGS. 1–4 could be modified to utilize the opening 60 shown in FIGS. 5 and 6 that does not include the lateral side opening toward the base 2. Neither of such modifications to the rail clip of the invention would depart from its spirit and scope.

What is claimed is:

1. A rail clip for securing a rail to a foundation, the rail clip engaging a rail foot extending laterally from the rail and being attached to an anchor projecting from the foundation, comprising:

a base positioned on the foundation and having an opening through which the anchor projects, said anchor having an upper portion not projecting above the base;

a nose overlying and engaging the rail foot; and a pair of spaced apart fingers affixed to and forming a unitary body with the nose and the base, the pair of fingers straddling said opening in the base and the anchor projecting therethrough; and securement means positioned between the pair of fingers laterally opposite the rail foot and engaging the anchor for attaching the rail clip to the foundation.

2. The rail clip according to claim 1 wherein:

the opening in the base has a side which opens from the base in the direction of the rail foot; and the base has a side facing the rail foot, the open side of said opening being in said base side, the base side adjustment said open side extending laterally toward the rail foot.

3. A rail clip for securing a rail to a foundation, the rail including a foot extending laterally from the rail and having a height above the foundation, the rail clip engaging the foot and being attached to an anchor projecting from the foundation, comprising:

a base positioned on the foundation, the base having an upper portion including an upper surface at a height not greater than the height of the rail foot and an opening through which the anchor projects, said anchor having an upper portion not projecting above the base;

a nose overlying and engaging the rail foot; and a pair of spaced apart fingers affixed to the nose and to the upper portion of the base, the fingers straddling the opening in the base.

4. The rail clip according to claim 3 further comprising securement means engaging the upper surface of the base and engaging the anchor for attaching the rail clip to the foundation.

5. The rail clip according to claim 4 wherein the securement means is positioned laterally opposite the rail foot.

6. A rail clip for securing a rial to a foundation, the rail clip engaging a rail foot extending laterally from the rail and being attached to an anchor projecting from the foundation, comprising:

a base positioned on the foundation and having an opening through which the anchor projects, said anchor having an upper portion not projecting above the base;

a nose overlying and engaging the rial foot;

a pair of spaced apart fingers affixed to and forming a unitary body with the nose and the base, the pair of fingers straddling said opening in the base and the anchor projecting therethrough; and a recess formed by the pair of fingers, the base and the nose, the nose including a wall forming a front wall of the recess toward the rial.

7. The rail clip according to claim 6 further comprising securement means positioned in the recess laterally opposite the front wall of the recess and engaging the anchor for attaching the rail clip to the foundation.

8. THe rail clip according to claim 7 wherein the securement means is also positioned laterally opposite the rail foot.

9. The rail clip according to claim 7 wherein the front wall of the recess is positioned laterally from the securement means a distance sufficient to provide the clearance necessary for attachment of the securement means to the anchor.

10. A rial clip for securing a rial to a foundation, the rail clip engaging a rail foot extending laterally from the rail and being attached to an anchor projecting from the foundation, comprising:

a base positioned on the foundation and having an opening through which the anchor projects, a nose overlying and engaging the rail foot;

a pair of spaced apart fingers affixed to and forming a unitary body with the nose and base, the pair of fingers straddling said opening in the base and the anchor projecting therethrough;

a recess formed by the pair of fingers, the base and the nose, the nose including a wall forming a front wall of the recess toward the rial;

securement means positioned in the recess laterally opposite the front wall of the recess and engaging the anchor for attaching the rial clip to the foundation; and the front wall of the recess is positioned laterally from the securement means a distance sufficient to provide the clearance necessary for attachment of the securement means to the anchor.

11. A rial clip for securing a rail to a foundation, the rail clip engaging a rial foot extending laterally from the rail and being attached to an anchor projecting from the foundation, comprising:

a base positioned on the foundation and having an opening through which the anchor projects;

a nose overlying the rail foot and including a pair of spaced apart rubber pads engaging the rail foot, the pads being spaced apart in the direction of the length of the rail a distance sufficient to avoid interference of the pads with the projecting of the anchor through the base;

a pair of spaced apart fingers affixed to and forming a unitary body with the nose and the base, the pair of fingers straddling said opening in the base and the anchor projecting therethrough; and a recess formed by the pair of fingers, the base and the nose, the nose including a wall forming a front wall of the recess toward the rail, at least a portion of the front wall of the recess being positioned in the space between the pair of rubber pads.

* * * * *